US010448773B2

(12) United States Patent
Muñiz

(10) Patent No.: US 10,448,773 B2
(45) Date of Patent: Oct. 22, 2019

(54) SYSTEM FOR MOUNTING A CURTAIN ROD

(71) Applicant: Albert Muñiz, Harlingen, TX (US)

(72) Inventor: Albert Muñiz, Harlingen, TX (US)

( * ) Notice: Subject to any disclaimer, the term of this patent is extended or adjusted under 35 U.S.C. 154(b) by 874 days.

(21) Appl. No.: 14/963,978

(22) Filed: Dec. 9, 2015

(65) Prior Publication Data

US 2016/0157655 A1 Jun. 9, 2016

Related U.S. Application Data

(60) Provisional application No. 62/089,312, filed on Dec. 9, 2014.

(51) Int. Cl.

| | |
|---|---|
| ***A47H 1/13*** | (2006.01) |
| ***A47H 1/122*** | (2006.01) |
| ***A47H 1/142*** | (2006.01) |
| *F21S 8/00* | (2006.01) |
| *F21V 33/00* | (2006.01) |

(52) U.S. Cl.

CPC ..... *A47H 1/122* (2013.01); *A47H 1/142* (2013.01); *F21S 8/036* (2013.01); *F21V 33/0028* (2013.01)

(58) Field of Classification Search

CPC ..... A47H 1/142; A47H 1/122; F16B 2/12; F16M 13/022

See application file for complete search history.

(56) References Cited

U.S. PATENT DOCUMENTS 1,356,237 A * 10/1920 Szefczyk ..... E06B 9/50 248/271
3,241,684 A * 3/1966 Willsey ..... A47H 1/022 221/105.1
4,140,294 A * 2/1979 Zwarts ..... A47H 1/122 248/265
4,179,091 A * 12/1979 Bidney ..... A47H 1/144 248/265
4,322,050 A * 3/1982 Roach ..... A47H 1/122 248/222.51
6,311,851 B1 * 11/2001 Knudsen, Sr. ..... A01G 5/04 211/13.1

* cited by examiner

*Primary Examiner* — Amy J. Sterling

(57) ABSTRACT

A system for mounting a curtain rod is used to mount a rod holder to a wall without damaging the wall if the rod holder is removed or changed. The system includes a holder mounting bracket which includes a base and a bridge. The holder mounting bracket may be mounted to a wall by the base. An anchor-receiving hole runs between the base and the bridge. The system includes a rod holder which is mounted into the anchor-receiving hole and to the bridge. The rod holder is used to support a curtain rod. The system includes a bracket adapter which mounts into the anchor-receiving hole if the rod holder is not compatible with the holder mounting bracket. The rod holder may then be mounted to the bracket adapter. The system includes a holder cover and a bracket cover, used to cover the rod holder and the holder mounting bracket respectively.

18 Claims, 14 Drawing Sheets

SYSTEM FOR MOUNTING A CURTAIN ROD

The current application claims a priority to the U.S. Provisional Patent application Ser. No. 62/089,312 filed on Dec. 9, 2014.

FIELD OF THE INVENTION

The present invention relates generally to window curtains. More specifically, the present invention relates to systems for mounting a curtain rod that allow curtain rod holders to be interchanged, as desired, without further damaging the wall used to mount the curtain rod.

BACKGROUND OF THE INVENTION

When hanging curtains over a window, the most common method of mounting a curtain rod involves screwing two or more curtain rod holders into the wall surrounding the window. While this method is effective at supporting a curtain rod and the curtains themselves, the process of installing the curtain rod holder can be difficult. Generally, a user must do a considerable amount of measuring to ensure that the rod holders are aligned properly and positioned over a stud. If done incorrectly, the rod holders may not be centered over the window or may be mounted at an angle. In either case, the user would likely need to adjust the position of one or more of the rod holders, leaving behind holes from the screws used to originally mount the rod holder. Moreover, if the user ever wishes to change out the curtain rod holders with new ones, if the new rod holders have holes which do not align with the old rod holders, new holes must be made in the wall.

Accordingly, there is a present need for a system which can be used to standardize the process for mounting curtain rods such that the user will be able to easily align each of the rod holders properly and may interchange rod holders without further damaging the wall after the initial installation. The present invention uses a holder mounting bracket which is mounted onto a wall instead of directly mounting the rod holder onto the wall. The holder mounting bracket may be mounted using regular screws or may, alternatively be mounted using drywall anchor screws. Because the rod holder is mounted to the holder mounting bracket, the holder mounting bracket does not need to be removed when swapping out rod holders. A mounting template is adhered to the holder mounting bracket to help the user with the installation process and prevent user error.

DETAILED DESCRIPTION OF THE INVENTION

All illustrations of the drawings are for the purpose of describing selected versions of the present invention and are not intended to limit the scope of the present invention.

Figure 1:
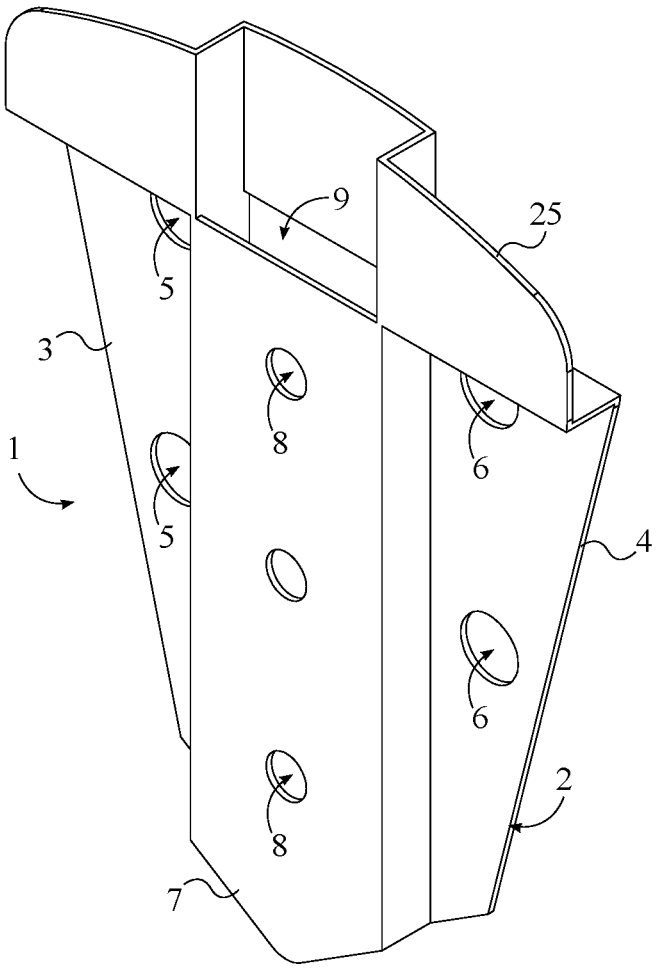
FIG. 1 is a front perspective view of the holder mounting bracket.
Figure 2:
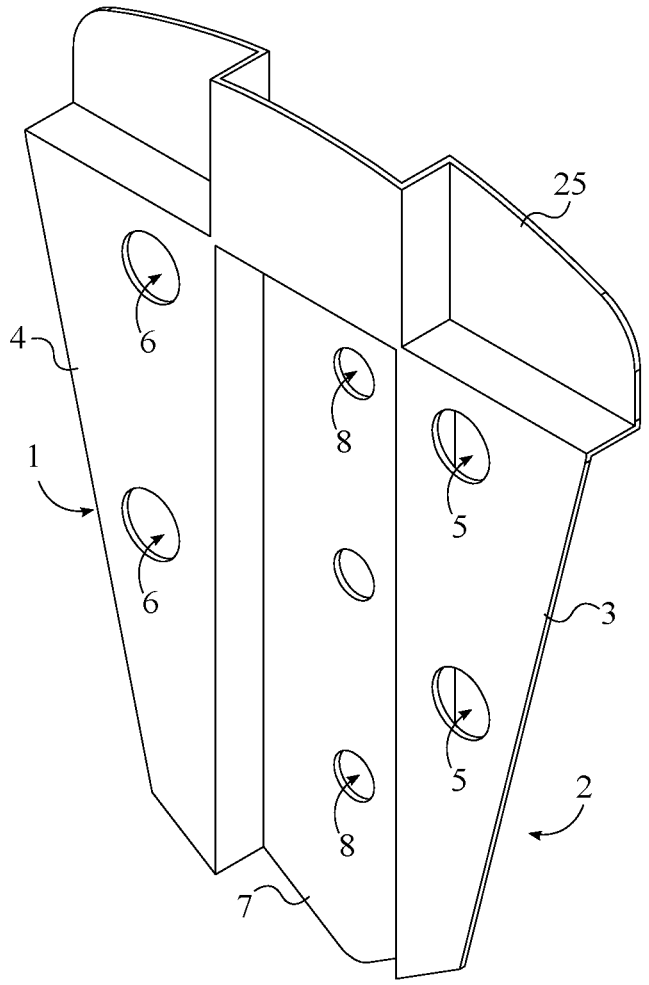
FIG. 2 is a rear perspective view of the holder mounting bracket.
Figure 3:
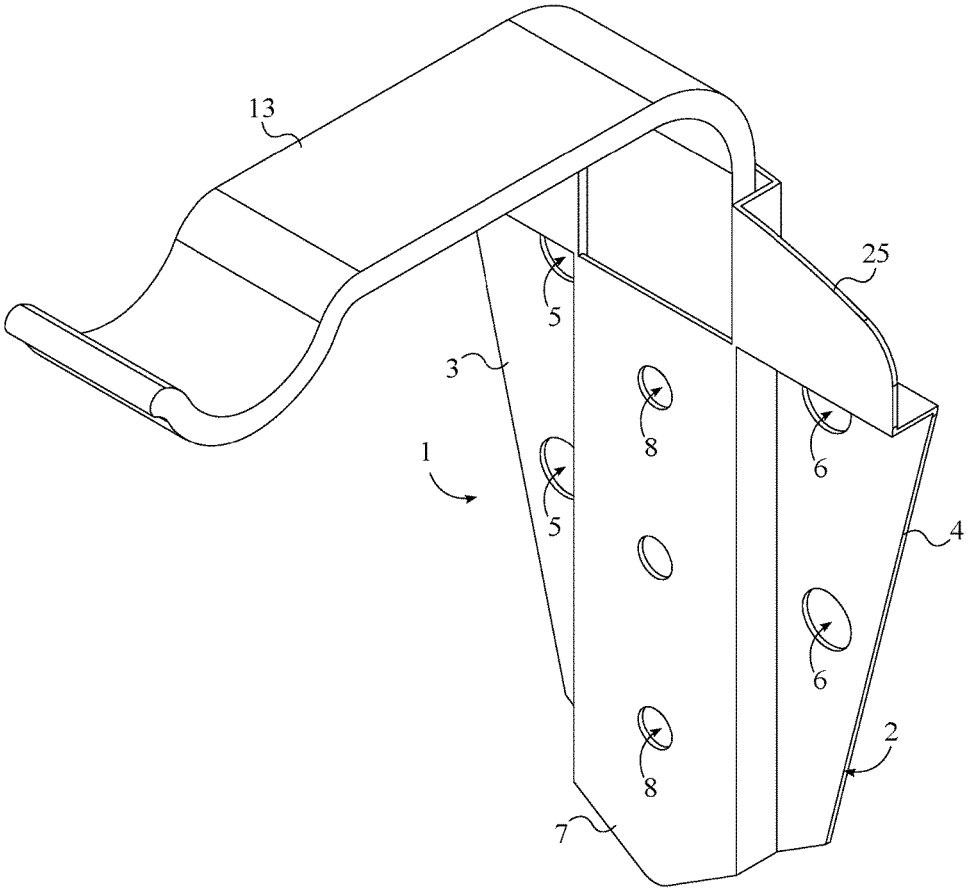
FIG. 3 is a front perspective view of the first configuration of the present invention, wherein the rod holder is mounted to the holder mounting bracket.
Figure 6:
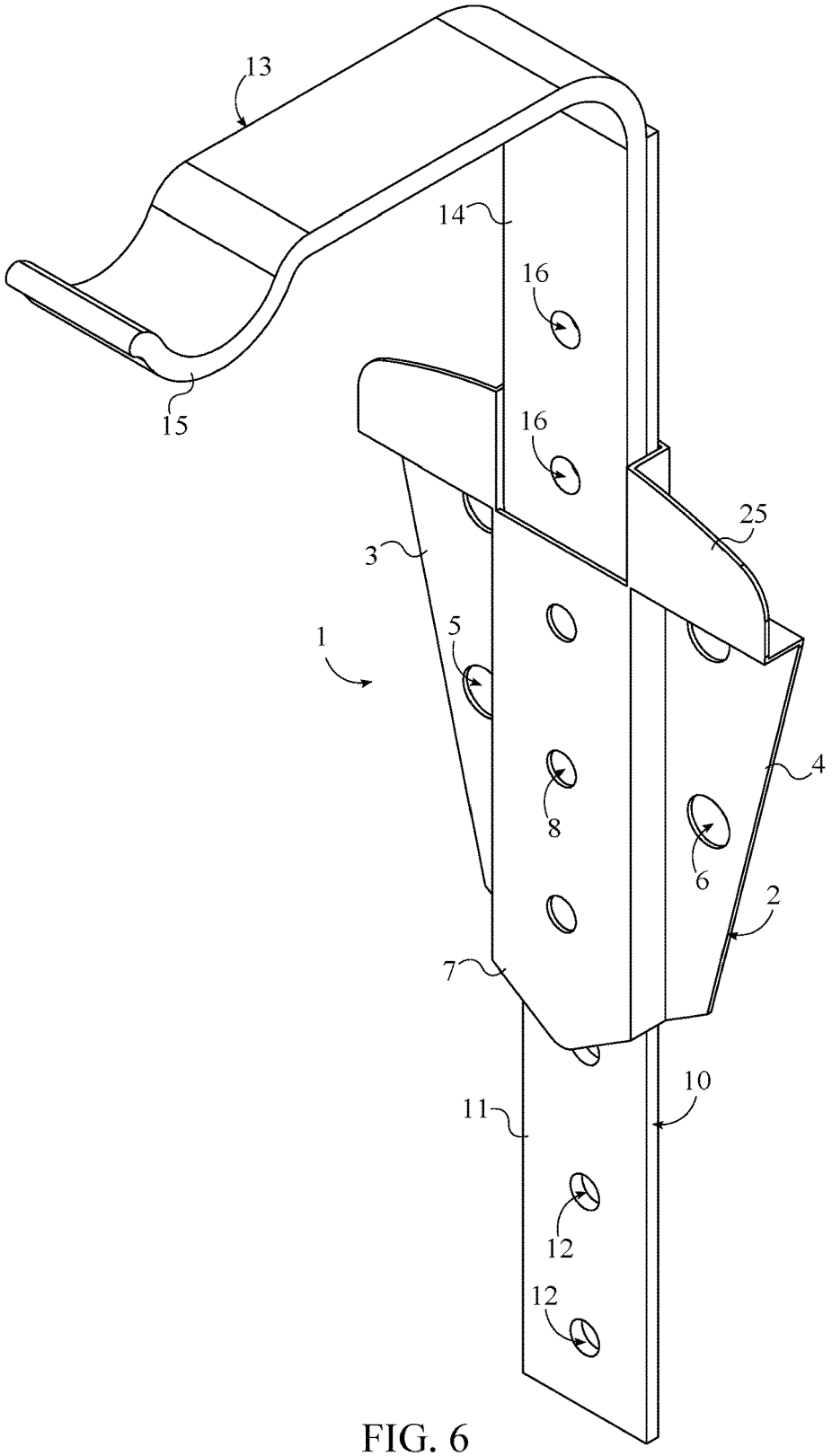
FIG. 6 is a front perspective view of the second configuration of the present invention, wherein the rod holder is mounted to the holder mounting bracket by the bracket adapter.

With reference to FIGS. 1-3, the present invention is a system for mounting a curtain rod that accepts various types of rod holders 13. The present invention also allows rod holders 13 to be easily swapped out without damaging the wall in which the rod holder 13 is mounted. The present invention comprises a holder mounting bracket 1, which comprises a base 2 and a bridge 7. The holder mounting bracket 1 is designed to accept various types of rod holders 13 and is the only component of the present invention which must be directly anchored to a wall. The base 2 creates a flat and sturdy interface for the system to be mounted to a wall. The base 2 comprises a first flange 3, a second flange 4, a plurality of first mounting holes 5, and a plurality of second mounting holes 6. The first flange 3 is connected adjacent to the bridge 7. The second flange 4 is connected adjacent to the bridge 7, opposite to the first flange 3. The positioning of the first flange 3 and the second flange 4 creates a recessed space for a rod holder 13 to slide in between the first flange 3 and the second flange 4. The first flange 3 and the second flange 4 are positioned coplanar with each other so that the base 2 can be easily placed against a wall. The bridge 7 is used to mount a rod holder 13 to the holder mounting bracket 1. The bridge 7 is offset normal from the first flange 3 and the second flange 4. This creates an anchor-receiving hole 9 which is perimetrically delineated by the first flange 3, the second flange 4, and the bridge 7. A rod holder 13 or a bracket adapter 10, shown in FIG. 6, may be positioned within the anchor-receiving hole 9 to ultimately secure a rod holder 13 to the holder mounting bracket 1. The plurality of first mounting holes 5 traverses normal and through the first flange 3. Similarly, the plurality of second mounting holes 6 traverses normal and through the second flange 4. The plurality of first mounting holes 5 and the plurality of second mounting holes 6 allow bolts or screws to be used to secure the holder mounting bracket 1 to a wall or some other vertical surface. Because the rod holder 13, itself, is not directly mounted to the wall, the rod holder 13 may be easily swapped out with another rod holder 13 if desired by the user.

Figure 4:
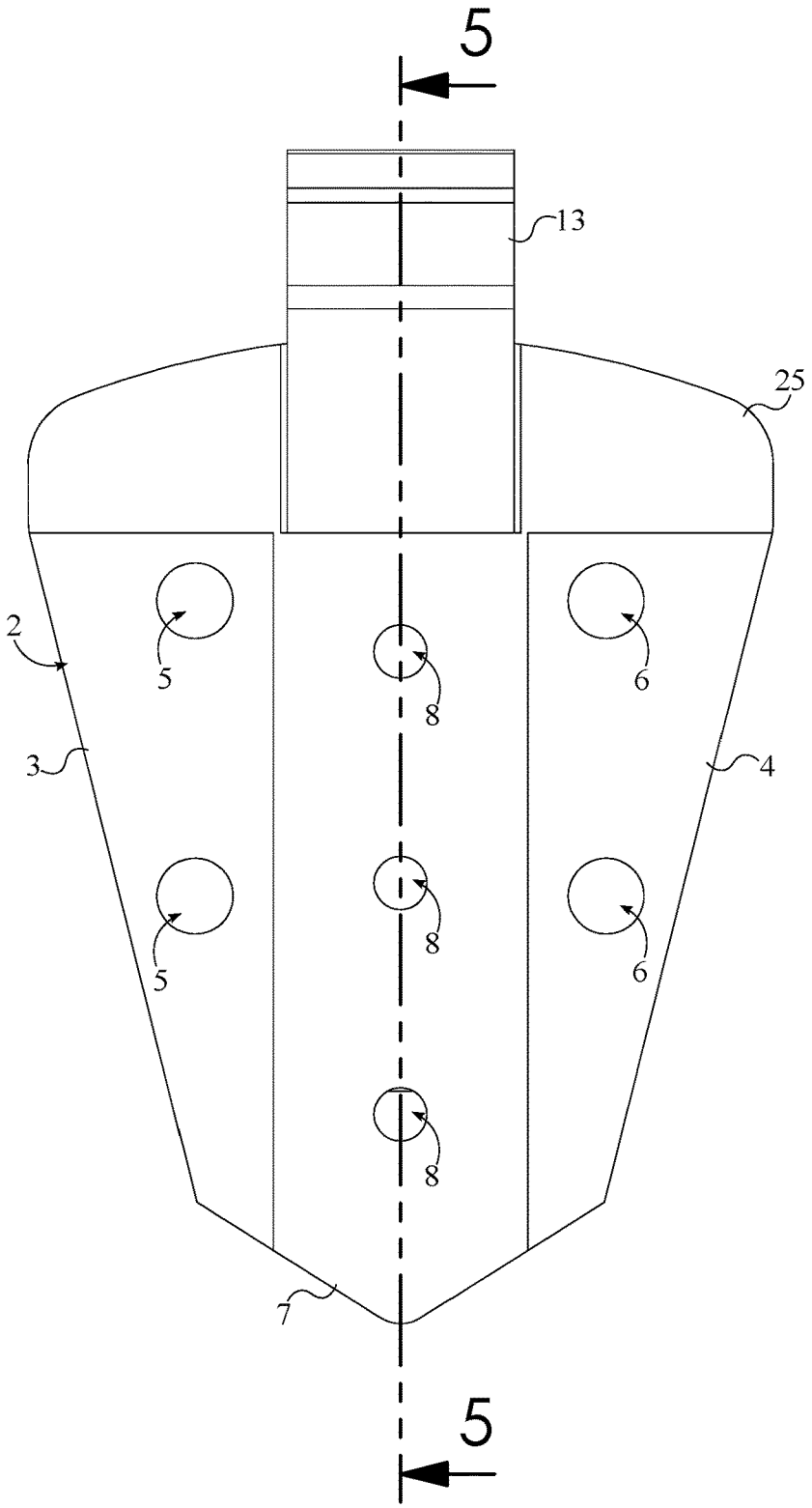
FIG. 4 is a front view of the first configuration of the present invention.
Figure 5:
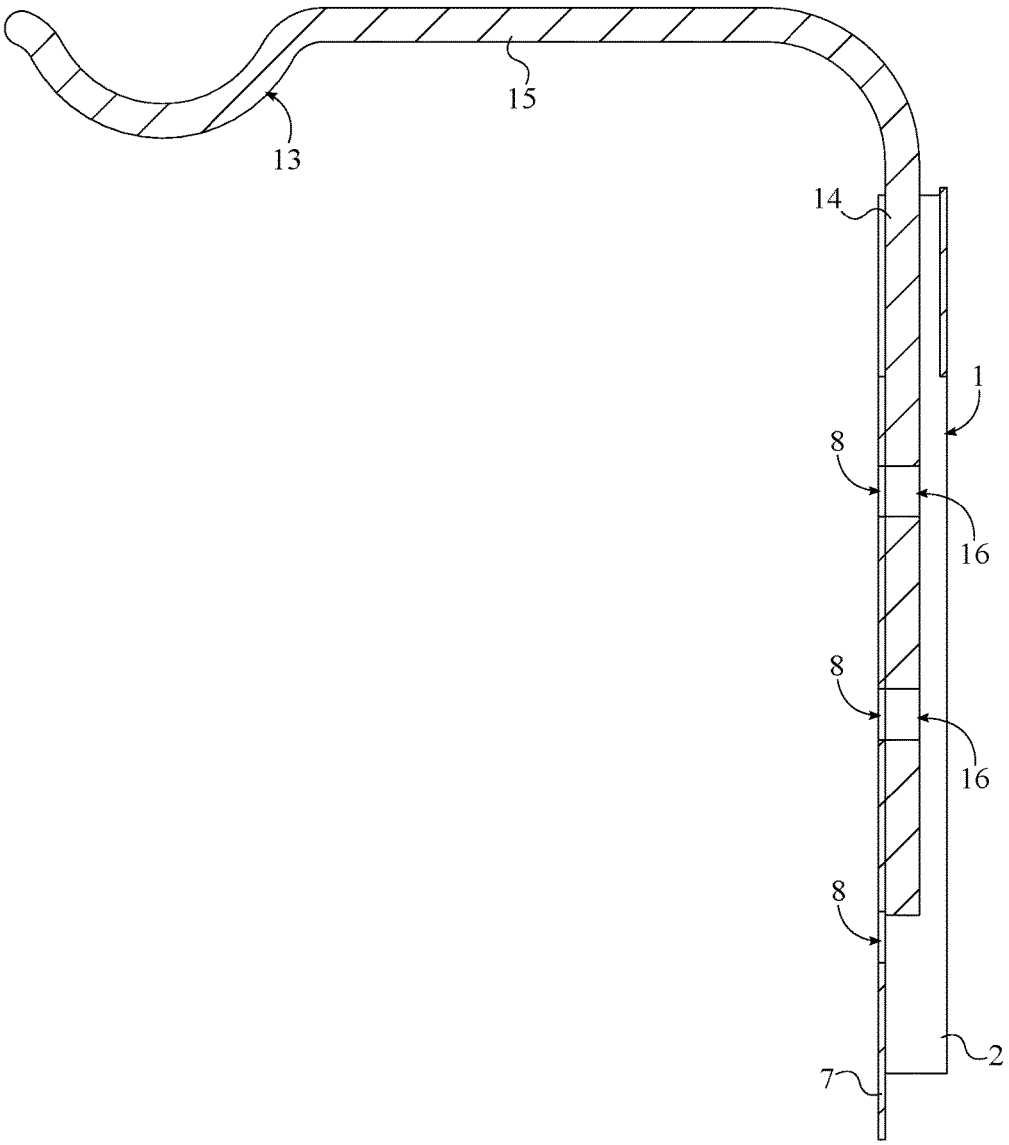
FIG. 5 is a section view of the first configuration of the present invention taken along line 5-5 in FIG. 4.
Figure 10:
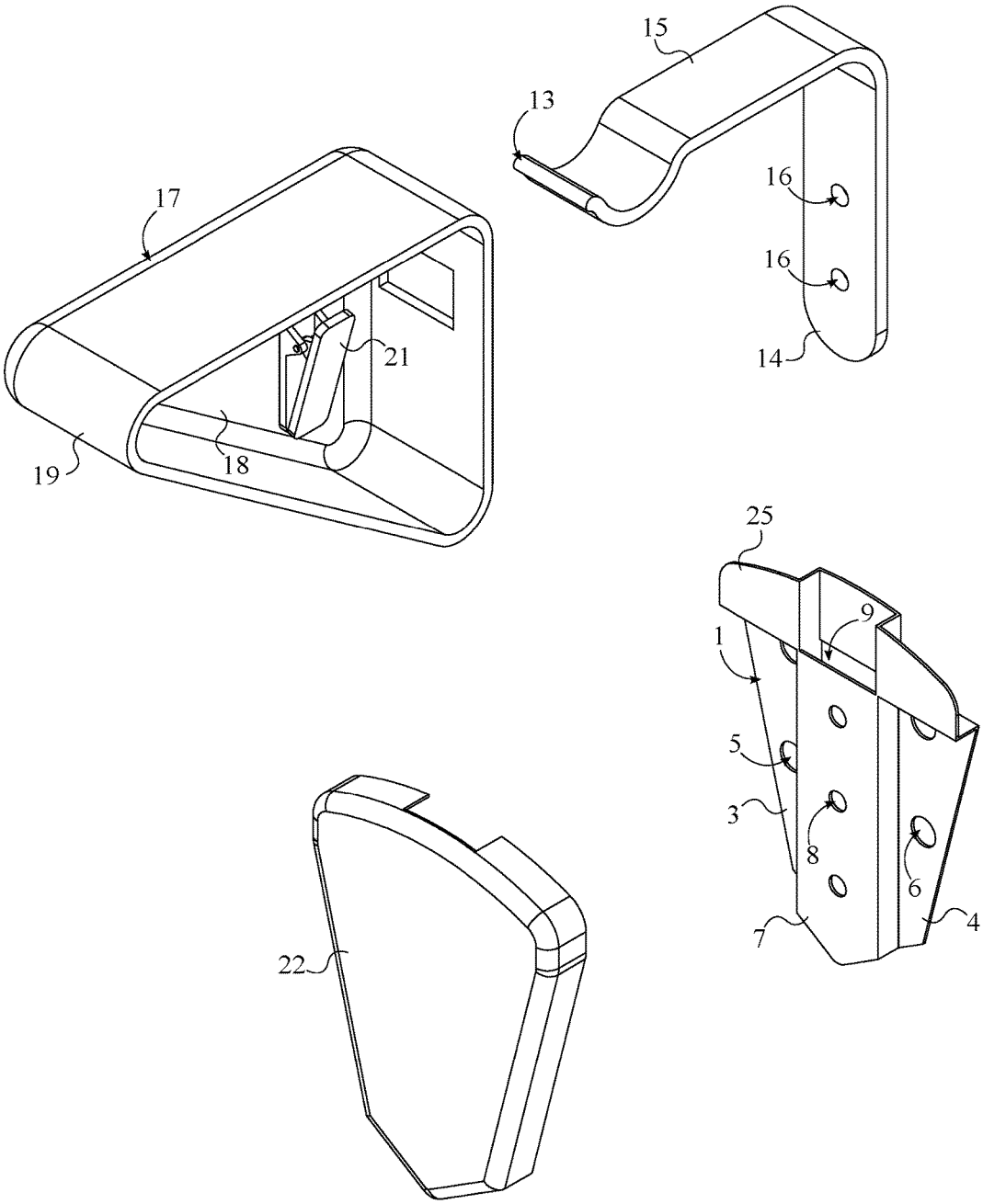
FIG. 10 is a front perspective exploded view of the first configuration of the present invention.

In reference to FIG. 3 and FIG. 10, the present invention further comprises a rod holder 13 which is used to secure a curtain rod above a window. The rod holder 13 comprises an anchor plate 14, a holder arm 15, and a plurality of anchor holes 16. The holder arm 15 is connected adjacent and normal to the anchor plate 14. The holder arm 15 is used to suspend a curtain rod above a window and offset from the wall in which the present invention is mounted to. The plurality of anchor holes 16 traverses normal and through the anchor plate 14 which is mounted to the bridge 7. Screws, bolts, or other types of fasteners may be threaded through the plurality of anchor holes 16 and into the either the bridge 7 or a bracket adapter 10 in order to secure the anchor plate 14 in place. The present invention has two main configurations. In a first configuration, wherein the plurality of anchor holes 16 is compatible with the plurality of alignment holes 8, the rod holder 13 is connected directly to the holder mounting bracket 1. In a second configuration of the present invention, wherein the plurality of anchor holes 16 is not compatible with the plurality of alignment holes 8, the rod holder 13 is indirectly connected to the holder mounting bracket 1 by a bracket adapter 10. In the first configuration of the present invention, each of the plurality of anchor holes 16 is concentrically aligned with a corresponding hole from the plurality of alignment holes 8. This is shown in FIGS. 4-5. Bolts or screws may then be threaded through both the plurality of anchor holes 16 and the plurality of alignment holes 8 to lock the holder mounting bracket 1 and the rod holder 13 together. In this arrangement, the anchor plate 14 is positioned within the anchor-receiving hole 9 and is mounted adjacent to the bridge 7, which allows for a direct connection between the rod holder 13 and the holder mounting bracket 1.

Figure 12:
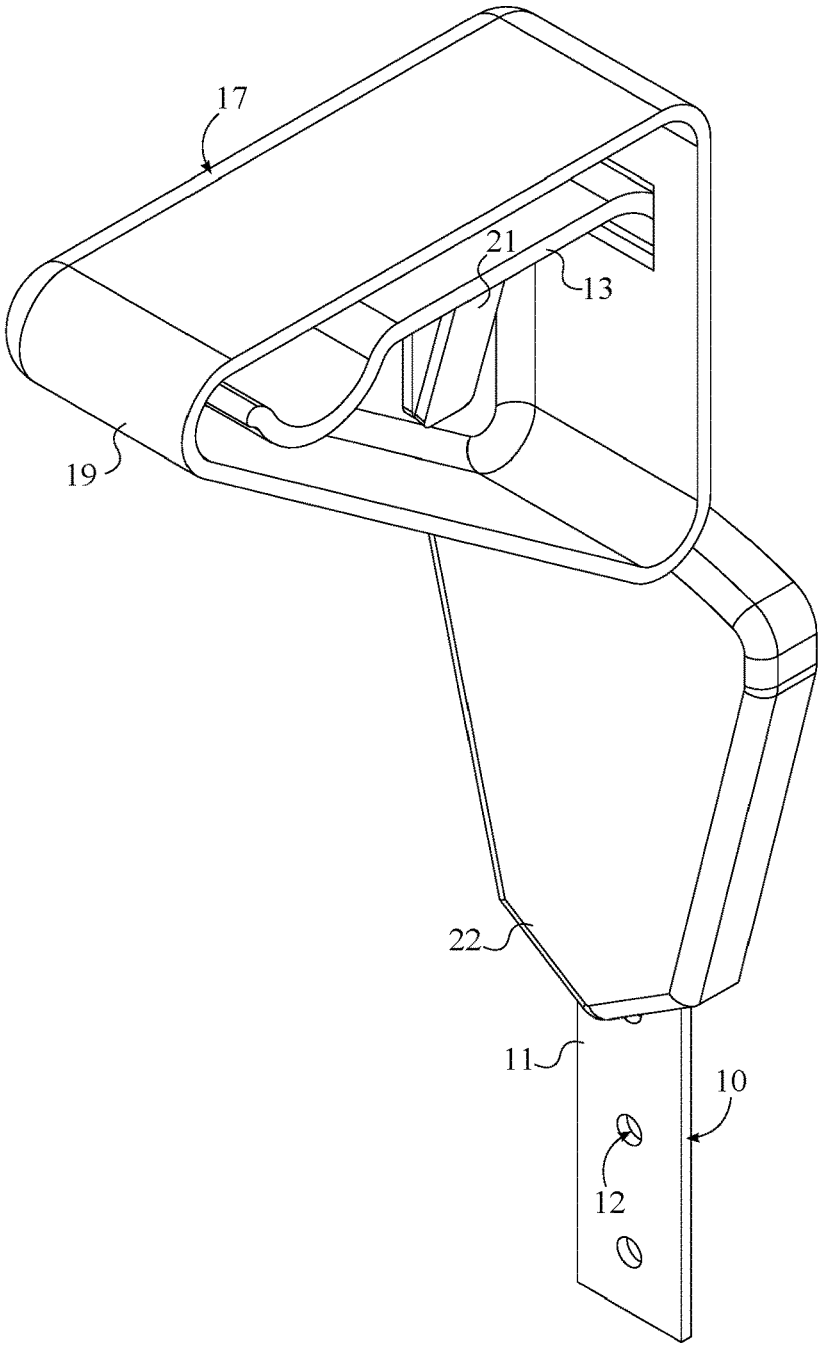
FIG. 12 is a front perspective view of the second configuration of the present invention.
Figure 13:
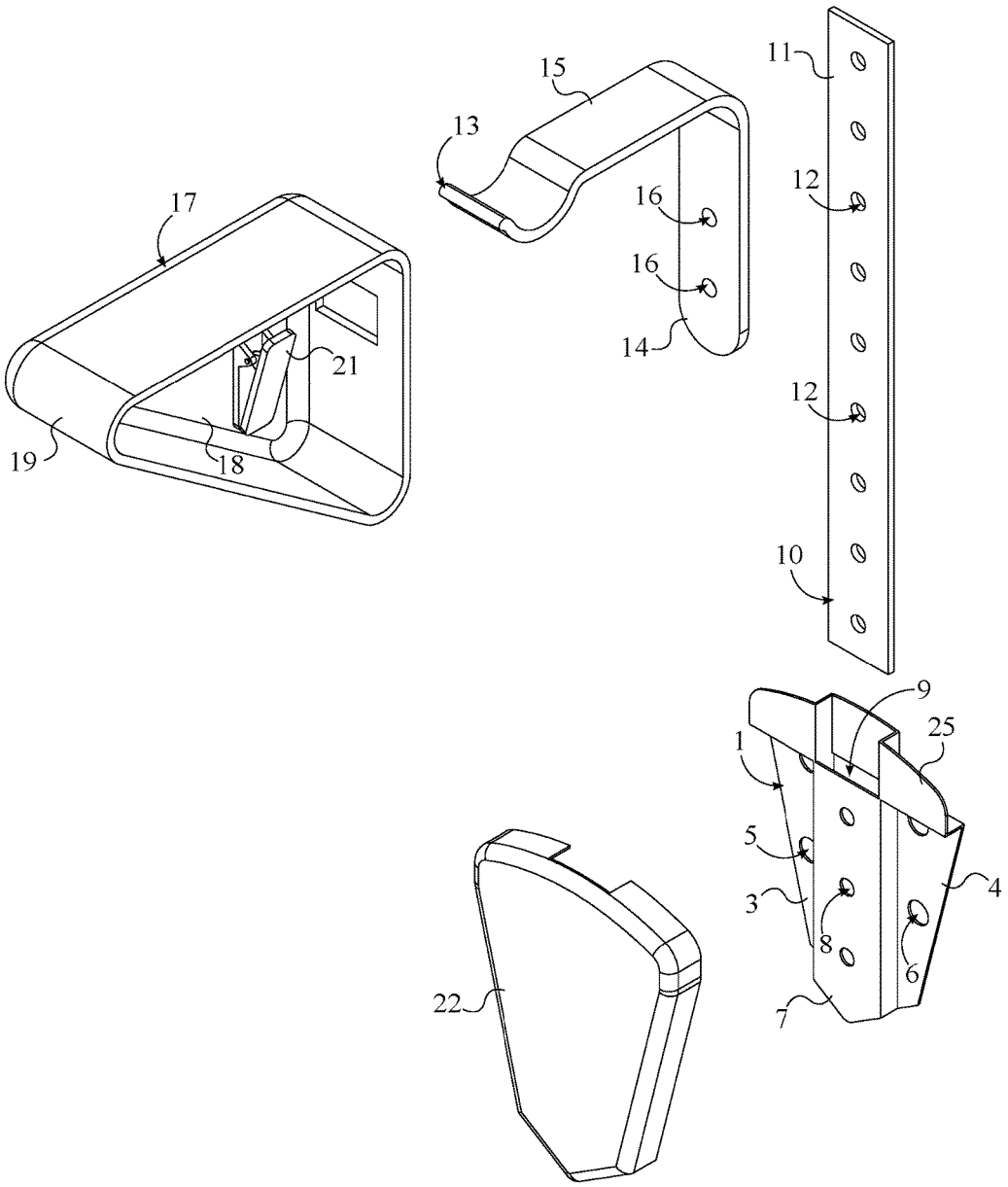
FIG. 13 is a front perspective exploded view of the second configuration of the present invention.

In the second configuration of the present invention, the present invention further comprises a bracket adapter 10. In reference to FIG. 6 and FIGS. 12-13, the bracket adapter 10 may be mounted adjacent to the bridge 7 and positioned within the anchor-receiving hole 9. The bracket adapter 10 comprises an elongated body 11 and a plurality of adapter holes 12. The plurality of adapter holes 12 traverses normal and through the elongated body 11. The plurality of adapter holes 12 are used to engage the elongated body 11 with the holder mounting bracket 1 and the rod holder 13. The holder mounting bracket 1 further comprises a plurality of alignment holes 8 which traverse normal and through the bridge 7. If the plurality of alignment holes 8 is not compatible with a rod holder 13, the rod holder 13 may be mounted to the elongated body 11 of the bracket adapter 10, which allows for an indirect connection between the rod holder 13 and the holder mounting bracket 1. In this situation, each of the plurality of alignment holes 8 is concentrically aligned with a corresponding hole from the plurality of adapter holes 12. This alignment allows bolts, screws, or other forms of fasteners to traverse through the plurality of alignment holes 8 and the plurality of adapter holes 12 to fix the bracket adapter 10 to the holder mounting bracket 1.

Figure 7:
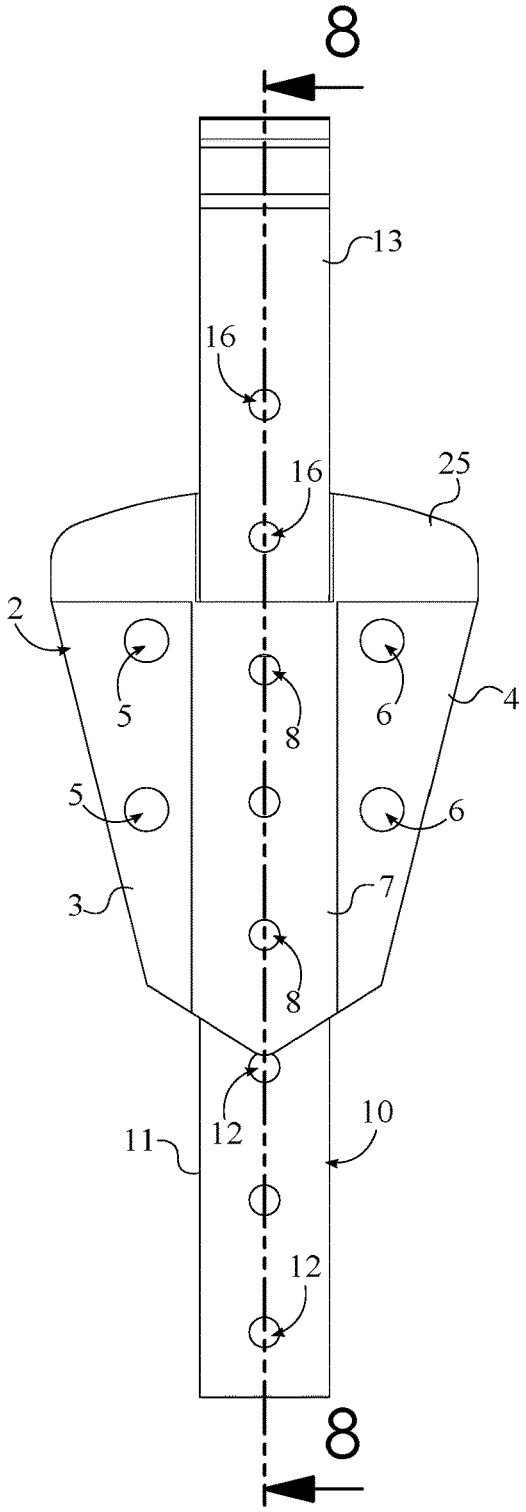
FIG. 7 is a front view of the second configuration of the present invention.
Figure 8:
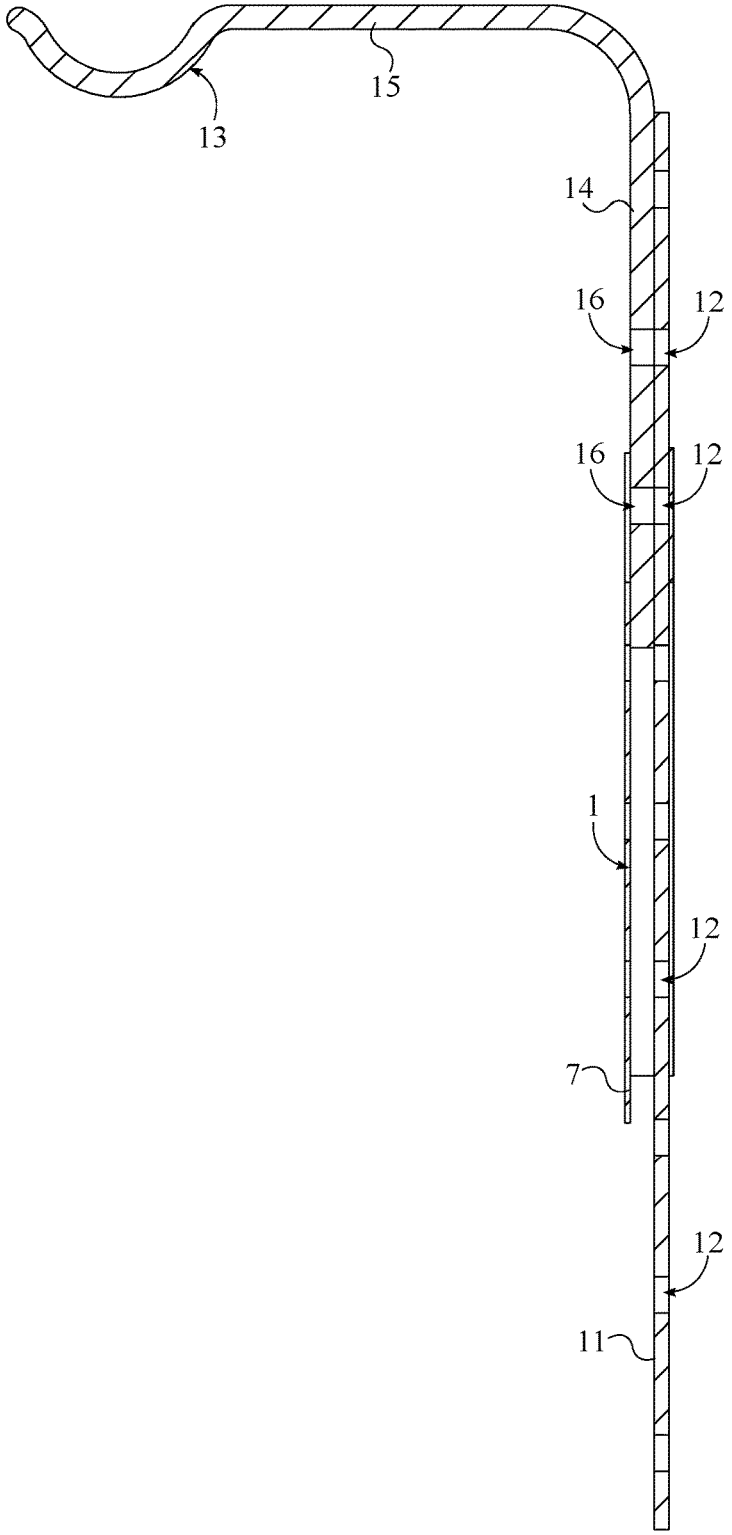
FIG. 8 is a section view of the second configuration of the present invention taken along line 8-8 in FIG. 7.

For the second configuration of the present invention, the anchor plate 14 is mounted adjacent to the bracket adapter 10 by bolting or screwing the anchor plate 14 to the bracket adapter 10. For the anchor plate 14 and the bracket adapter 10 to be oriented with each other properly, each of the plurality of anchor holes 16 is concentrically aligned with a corresponding hole from the plurality of adapter holes 12. This is shown in FIGS. 7-8. The plurality of adapter holes 12 may be unevenly distributed along the elongated body 11 to accommodate for rod holders 13 of varying dimensions.

Figure 9:
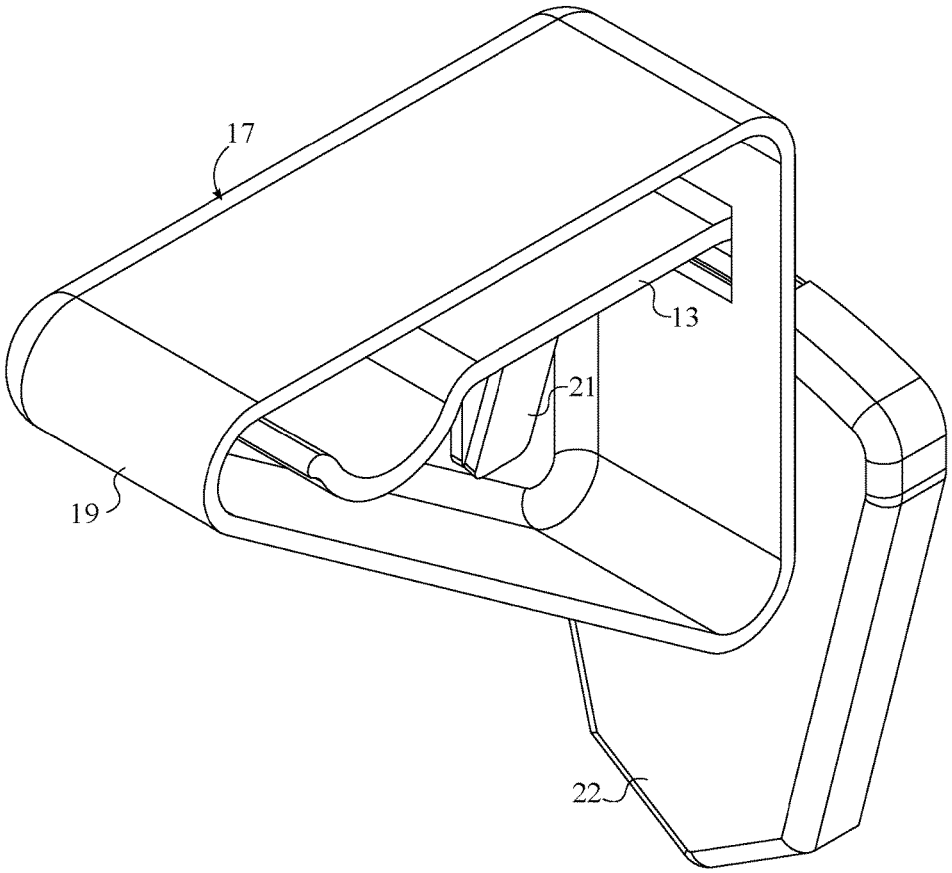
FIG. 9 is a front perspective view of the first configuration of the present invention.
Figure 11:
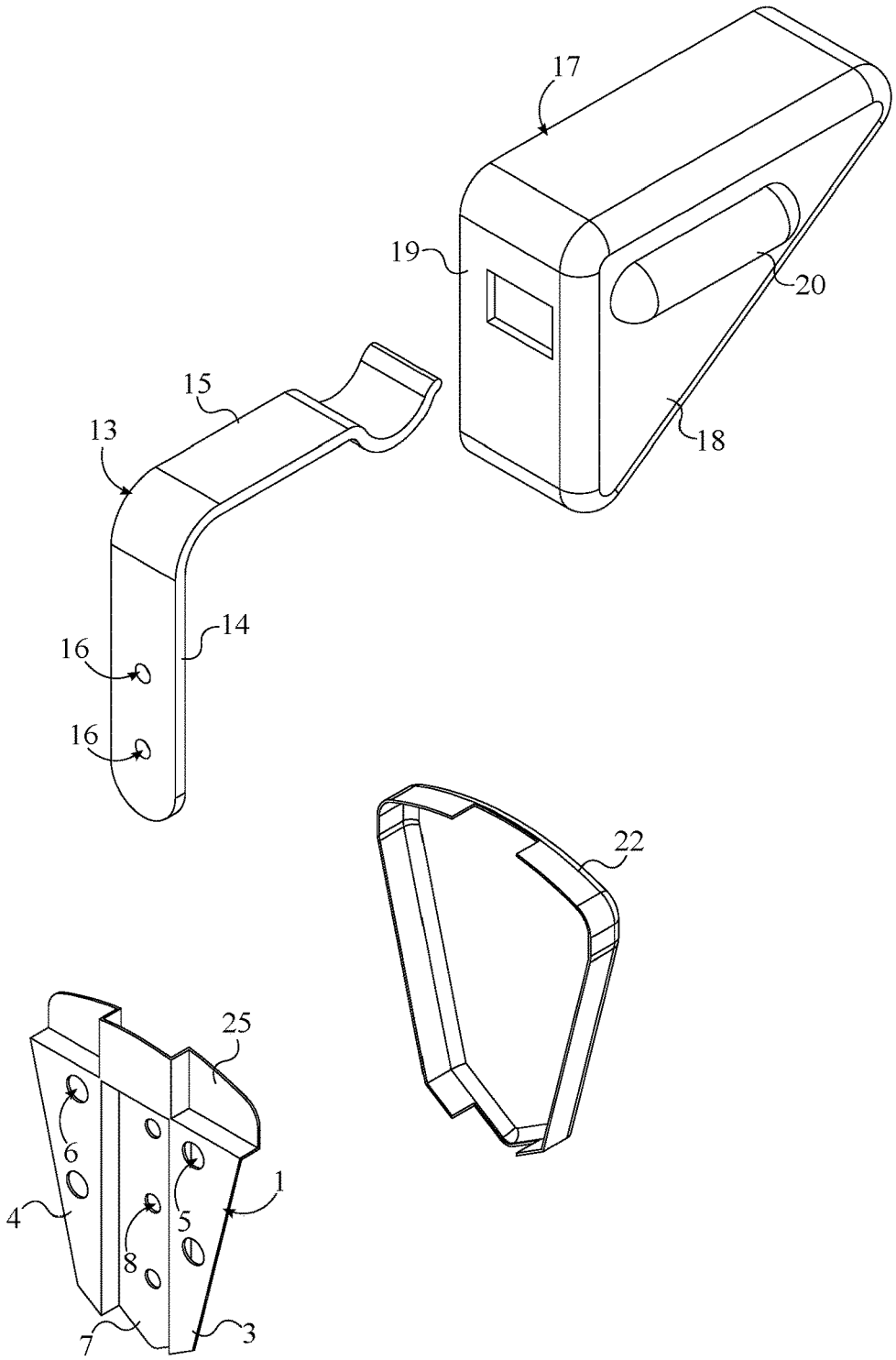
FIG. 11 is a rear perspective exploded view of the first configuration of the present invention.

In reference to FIGS. 9-11, the present invention further comprises a holder cover 17. The holder cover 17 is used to conceal the rod holder 13 and may further be used to hang additional curtain material. The holder cover 17 comprises a cover panel 18 and a lateral portion 19. The lateral portion 19 is perimetrically connected perpendicular to the cover panel 18. The holder arm 15 traverses through the lateral portion 19 and is positioned within the lateral portion 19 such that the holder arm 15 cannot be easily seen. The holder cover 17 may include various features depending on the preferences of the user. In one embodiment of the holder cover 17, the holder cover 17 comprises a light fixture 20. The light fixture 20 is mounted onto the cover panel 18 and may be used decoratively or to illuminate a room. In another embodiment of the holder cover 17, the holder cover 17 further comprises at least one curtain clip 21. The at least one curtain clip 21 is attached adjacent to the cover panel 18 and is positioned within the lateral portion 19. The at least one curtain clip 21 may be used to guide a portion of the curtain towards the wall in which the holder mounting bracket 1 is mounted to prevent light from entering the room through the window. Alternatively, another smaller curtain may be attached to the at least one curtain clip 21 to achieve the same effect.

In reference to FIGS. 9-11, the present invention further comprises a bracket cover 22 which is mounted adjacent to the holder mounting bracket 1, opposite to the anchor-receiving hole 9. The bracket cover 22 is coextensive with the holder mounting bracket 1. This allows the bracket cover 22 to act not only as a decorative cover, but also as a means of protecting the holder mounting bracket 1 and any bolts or screws engaged with the holder mounting bracket 1. In the preferred embodiment of the present invention, the bracket cover 22 is a rigid piece; however, in alternative embodiments, the bracket cover 22 may be an adhesive sheet that is layered over the holder mounting bracket 1.

Figure 14:
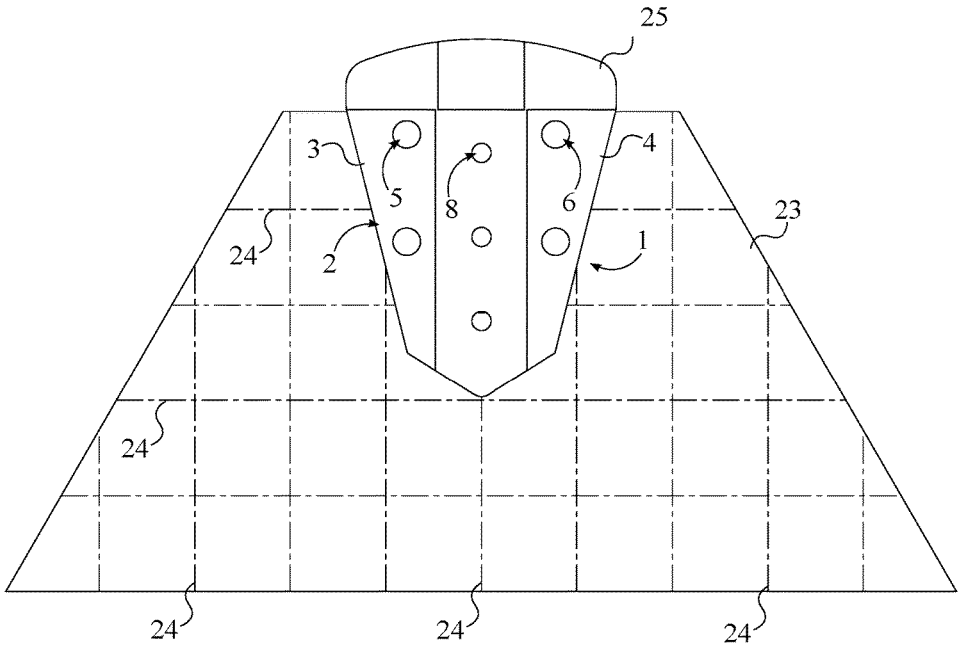
FIG. 14 is a front view of holder mounting bracket with the mounting template.

In reference to FIG. 14, the present invention further comprises a mounting template 23 and a plurality of measurement markings 24. The plurality of measurement markings 24 is incrementally distributed across the mounting template 23. In the preferred embodiment of the present invention, the plurality of measurement markings 24 is in the form of a grid; however, linear markings, angular markings, or any other form of measurement markings 24 may be used. Together, the mounting template 23 and the plurality of measurement markings 24 are used to help guide the user while installing the holder mounting bracket 1 onto a wall. The mounting template 23 is removably adhered to the base 2, opposite to the bridge 7. When installing the holder mounting bracket 1, the mounting template 23 is used to properly position the holder mounting bracket 1. Once the holder mounting bracket 1 is correctly aligned, the user may mark the locations of each of the plurality of mounting holes 5 on the wall and then remove the mounting template 23 before anchoring the holder mounting bracket 1 to the wall.

In the preferred embodiment, the present invention further comprises a wall protector 25. In reference to FIGS. 1-2, the wall protector 25 is connected adjacent to the base 2 and is used to prevent the rod holder 13 or the bracket adapter 10 from damaging the wall in which the holder mounting bracket 1 is mounted to. The wall protector 25 is aligned adjacent to the anchor-receiving hole 9 such that when the holder mounting bracket 1 is mounted to a wall, the wall protector 25 is positioned flush against the wall. As a result, when the rod holder 13 or the bracket adapter 10 is placed into the anchor-receiving hole 9, the rod holder 13 or the bracket adapter 10 slides against the wall protector 25 instead of the wall itself.

Although the invention has been explained in relation to its preferred embodiment, it is to be understood that many other possible modifications and variations can be made without departing from the spirit and scope of the invention as hereinafter claimed.

What is claimed is:

1. A system for mounting a curtain rod comprises:
a holder mounting bracket;
the holder mounting bracket comprises a base and a bridge;
the base comprises a first flange, a second flange, a plurality of first mounting holes, and a plurality of second mounting holes;
the first flange being connected adjacent to the bridge;
the second flange being connected adjacent to the bridge, opposite to the first flange;
the first flange and the second flange being positioned coplanar with each other;
the bridge being offset normal from the first flange and the second flange;
the plurality of first mounting holes traversing normal and through the first flange;
the plurality of second mounting holes traversing normal and through the second flange;
an anchor-receiving hole being perimetrically delineated by the first flange, the second flange, and the bridge;
a bracket cover;
the bracket cover being mounted adjacent to the holder mounting bracket, opposite to the anchor-receiving hole; and
the bracket cover being coextensive with the holder mounting bracket.

2. The system for mounting a curtain rod as claimed in claim 1 comprises:
a bracket adapter;
the bracket adapter being positioned within the anchor-receiving hole; and
the bracket adapter being mounted adjacent to the bridge.

3. The system for mounting a curtain rod as claimed in claim 2 comprises:
the bracket adapter comprises an elongated body and a plurality of adapter holes;
the holder mounting bracket further comprises a plurality of alignment holes;
the plurality of alignment holes traversing normal and through the bridge;
the plurality of adapter holes traversing normal and through the elongated body; and
each of the plurality of alignment holes being concentrically aligned with a corresponding hole from the plurality of adapter holes.

4. The system for mounting a curtain rod as claimed in claim 1 comprises:
a rod holder;
the rod holder comprises an anchor plate, a holder arm, and a plurality of anchor holes;
the holder arm being connected adjacent and normal to the anchor plate;
the plurality of anchor holes traversing normal and through the anchor plate; and
the anchor plate being mounted to the bridge.

5. The system for mounting a curtain rod as claimed in claim 4 comprises:
each of the plurality of anchor holes being concentrically aligned with a corresponding hole from the plurality of alignment holes;
the anchor plate being positioned within the anchor-receiving hole; and
the anchor plate being mounted adjacent to the bridge.

6. The system for mounting a curtain rod as claimed in claim 4 comprises:
a bracket adapter;
the bracket adapter comprises an elongated body and a plurality of adapter holes;
the bracket adapter being positioned within the anchor-receiving hole;
the bracket adapter being mounted adjacent to the bridge;
the plurality of adapter holes traversing normal and through the elongated body;
each of the plurality of anchor holes being concentrically aligned with a corresponding hole from the plurality of adapter holes; and
the anchor plate being mounted adjacent to the bracket adapter.

7. The system for mounting a curtain rod as claimed in claim 1 comprises:
a holder cover;
the holder cover comprises a cover panel and a lateral portion;
the lateral portion being perimetrically connected perpendicular to the cover panel;
the holder arm traversing through the lateral portion; and
the holder arm being positioned within the lateral portion.

8. The system for mounting a curtain rod as claimed in claim 7 comprises:
the holder cover comprises a light fixture; and
the light fixture being mounted onto the cover panel.

9. The system for mounting a curtain rod as claimed in claim 7 comprises:
the holder cover comprises at least one curtain clip;
the at least one curtain clip being attached adjacent to the cover panel; and
the at least one curtain clip being positioned within the lateral portion.

10. The system for mounting a curtain rod as claimed in claim 1 comprises:
a mounting template;
a plurality of measurement markings;
the plurality of measurement markings being incrementally distributed across the mounting template; and
the mounting template being removably adhered adjacent to the base, opposite to the bridge.

11. The system for mounting a curtain rod as claimed in claim 1 comprises:
a wall protector;
the wall protector being connected adjacent to the base; and
the wall protector being aligned adjacent to the anchor-receiving hole.

12. A system for mounting a curtain rod comprises:
a holder mounting bracket;
a rod holder;
the holder mounting bracket comprises a base, and a bridge;
the rod holder comprises an anchor plate, a holder arm, and a plurality of anchor holes;
the base comprises a first flange, a second flange, a plurality of first mounting holes, and a plurality of second mounting holes;
the first flange being connected adjacent to the bridge;
the second flange being connected adjacent to the bridge, opposite to the first flange;
the first flange and the second flange being positioned coplanar with each other;
the bridge being offset normal from the first flange and the second flange;
the plurality of first mounting holes traversing normal and through the first flange;

the plurality of second mounting holes traversing normal and through the second flange;

an anchor-receiving hole being perimetrically delineated by the first flange, the second flange, and the bridge;

the holder arm being connected adjacent and normal to the anchor plate;

the plurality of anchor holes traversing normal and through the anchor plate;

the anchor plate being mounted to the bridge;

a bracket cover;

the bracket cover being mounted adjacent to the holder mounting bracket, opposite to the anchor-receiving hole; and the bracket cover being coextensive with the holder mounting bracket.

13. The system for mounting a curtain rod as claimed in claim 12 comprises:

a bracket adapter;

the bracket adapter comprises an elongated body and a plurality of adapter holes;

the holder mounting bracket further comprises a plurality of alignment holes;

the bracket adapter being positioned within the anchor-receiving hole;

the bracket adapter being mounted adjacent to the bridge;

the plurality of alignment holes traversing normal and through the bridge;

the plurality of adapter holes traversing normal and through the elongated body; and each of the plurality of alignment holes being concentrically aligned with a corresponding hole from the plurality of adapter holes.

14. The system for mounting a curtain rod as claimed in claim 12 comprises:

each of the plurality of anchor holes being concentrically aligned with a corresponding hole from the plurality of alignment holes;

the anchor plate being positioned within the anchor-receiving hole; and the anchor plate being mounted adjacent to the bridge.

15. The system for mounting a curtain rod as claimed in claim 12 comprises:

a bracket adapter;

the bracket adapter comprises an elongated body and a plurality of adapter holes;

the bracket adapter being positioned within the anchor-receiving hole;

the bracket adapter being mounted adjacent to the bridge;

the plurality of adapter holes traversing normal and through the elongated body;

each of the plurality of anchor holes being concentrically aligned with a corresponding hole from the plurality of adapter holes; and the anchor plate being mounted adjacent to the bracket adapter.

16. The system for mounting a curtain rod as claimed in claim 12 comprises:

a holder cover;

the holder cover comprises a cover panel, a lateral portion, a light fixture, and at least one curtain clip;

the lateral portion being perimetrically connected perpendicular to the cover panel;

the holder arm traversing through the lateral portion;

the holder arm being positioned within the lateral portion;

the light fixture being mounted onto the cover panel;

the at least one curtain clip being attached adjacent to the cover panel; and the at least one curtain clip being positioned within the lateral portion.

17. The system for mounting a curtain rod as claimed in claim 12 comprises:

a mounting template;

a plurality of measurement markings;

the plurality of measurement markings being incrementally distributed across the mounting template; and the mounting template being removably adhered adjacent to the base, opposite to the bridge.

18. The system for mounting a curtain rod as claimed in claim 12 comprises:

a wall protector;

the wall protector being connected adjacent to the base; and the wall protector being aligned adjacent to the anchor-receiving hole.

* * * * *